United States Patent [19]

Fallot

[11] Patent Number: 4,572,773

[45] Date of Patent: Feb. 25, 1986

[54] ELECTROPLATING APPARATUS

[75] Inventor: Jean-Francois Fallot, Bienne, Switzerland

[73] Assignee: Egatec S.A., Canton of Bern, Switzerland

[21] Appl. No.: 704,262

[22] Filed: Feb. 22, 1985

[30] Foreign Application Priority Data

Mar. 20, 1984 [CH] Switzerland ..... 1396/84

[51] Int. Cl.[4] ..... C25D 17/22

[52] U.S. Cl. ..... 204/201; 204/222; 204/271

[58] Field of Search ..... 204/199, 222, 271, 201

[56] References Cited

U.S. PATENT DOCUMENTS 2,721,834 10/1955 Koury ..... 204/222
3,397,126 8/1968 Gilbert ..... 204/222
3,420,766 1/1969 Michelson ..... 204/222
4,229,276 10/1980 Kobayashi ..... 204/222

*Primary Examiner*—T. M. Tufariello
*Attorney, Agent, or Firm*—Silverman, Cass & Singer

[57] ABSTRACT

A container basin adapted to contain the workpieces to be electroplated is carried at the lower end of a tubular element, to the opposite upper end of which is screwed a power take-off stem of a vibrator. A body of the vibrator is provided with a hook enabling the apparatus to be hung up above the treatment vessel of an electroplating installation. The basin contains a helical ramp in such manner that, when the basin is submitted to a vibratory movement produced by the vibrator, the contained workpieces ascend along said ramp and fall down at the upper end of this latter when they have travelled along its complete length. The apparatus is portable and can be passed from one treatment vessel to another.

4 Claims, 3 Drawing Figures

ELECTROPLATING APPARATUS

BACKGROUND OF THE INVENTION

1. Field of the Invention

The present invention relates to an electroplating apparatus.

2. Description of the Prior Art

Electroplating installations are known, comprising a basket which receives the workpieces to be plated and which is subject to the action of a vibrator device which imparts to it an oscillatory rotative movement. Said basket is provided with a helical ramp coaxial with the axis of oscillation, the arrangement producing a continuous movement of the workpieces located in the basket.

However, in such known arrangements, the vibrator device is an integral part of the electroplating installation.

SUMMARY OF THE INVENTION

The object of the present invention is to furnish a portable apparatus for producing the agitation of workpieces submitted to electroplating treatment which can be used with any installation and, especially, can pass from one treatment vessel to another such vessel.

To this effect, the electroplating apparatus according to the invention comprises an elongate element at one end of which is secured the power take-off member of a vibrator which carries, at its other end, a container adapted to receive workpieces to be electroplated, the body of the vibrator being provided with means for supporting the apparatus which enable it to be placed above the treatment vessel of an electroplating installation.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be used and structural changes may be made as desired by those skilled in the art without departing from the present invention and the purview of the appended claims.

DESCRIPTION OF THE PREFERRED EMBODIMENT

Figure 1:
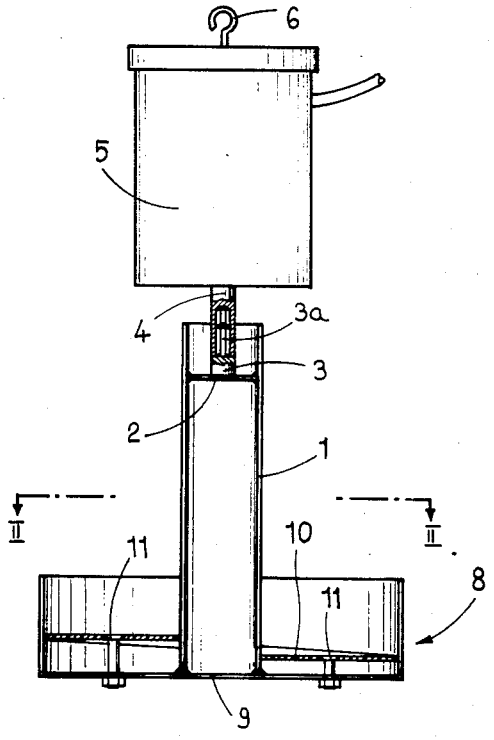
FIG. 1 is an axial sectional view of a portable electroplating apparatus in accordance with the invention.
Figure 2:
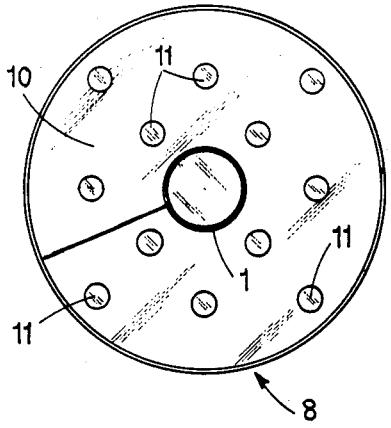
FIG. 2 is a sectional view of the apparatus along line II—II of FIG. 1.
Figure 3:
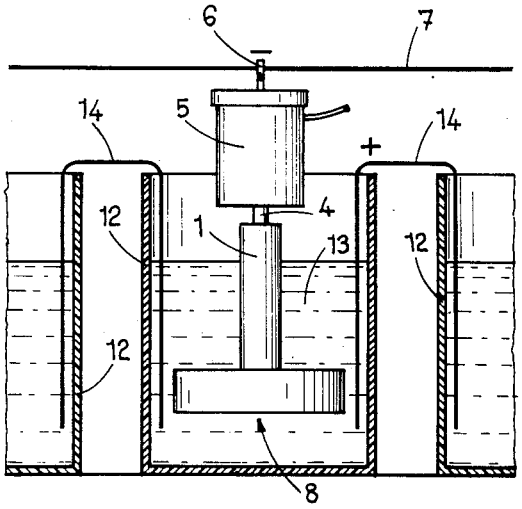
FIG. 3 is a sectional view of a section of an electroplating installation in which the present apparatus is represented in an operative position.

The apparatus illustrated comprises an elongate element 1, which is tubular and provided, in the vicinity of one of its ends, with a cross wall 2 which is welded in position. The wall 2 carries a journal 3 which terminates in a screw-threaded end 3*a*. The power take-off stem 4 of a vibrator device is screwed on to the threaded portion 3*a* of the journal 3. The body of the vibrating device, designated by reference 5, is provided with a hook 6 enabling the apparatus to be hung up supported by a wire, such as the wire 7 of the installation shown in FIG. 3, or alternatively to a supporting rod.

It is to be noted that the vibrator device 5 is a commercially available item being an apparatus which is normally used for feeding small workpieces to workshop machines.

The tubular element 1 carries, at its opposite lower end, a basin, generally designated by reference 8, adapted to contain the workpieces which have to be submitted to an electroplating treatment. The lower end of the tube 1 is welded centrally to the circular base, designated by reference 9, of this basin. The basin 8 is provided with a helical ramp 10, made of plastic material, extending for one complete revolution, which is provided with metal supporting studs 11 which are in contact with the metal base 9 of the basin 8.

When the apparatus is hung up on the wire 7 by its hook 6, above a vessel 12 for electroplating treatment (FIG. 3), the basin 8 is immersed in the electroplating bath, designated by reference 13, contained in the vessel 12. The wire 7 is connected to the negative terminal of a DC power generator and thus constitutes the cathode. Electrodes 14, constituting anodes since they are connected to the positive terminal of the power generator, are themselves immersed in the vessels 12 of the electroplating installation.

When the vibrator device 5 is in operation, its power take-off stem 4 is submitted to an oscillatory rotative movement which is transmitted, through the tubular element 1, to the basin 8. It is to be noted that the mass of the vibrator 5 with respect to that of the tubular element 1, of the basin 8 and of the workpieces which it contains, is sufficiently great so that even if the vibrator is not rigidly held, being merely hung up by its hook 6, the oscillatory movements to which the vibrator 5 itself is subjected are negligible with respect to those of the basin 8.

As the basin is submitted to a vibratory oscillatory movement, the axis of which coincides with the axis of the helical ramp 10, the workpieces contained in the basin ascend along this ramp and fall down at its upper end when they have travelled along its whole length.

The apparatus, which is portable, can easily be transferred from one vessel to another vessel of an electroplating installation, or even from one electroplating installation to another such installation.

The supporting means of the apparatus could be different from the simple hook 6 as described and illustrated.

I claim:

1. Electroplating apparatus comprising a portable vibrator having a body and a power take-off member, an elongate element to one end of which is secured said power take-off member of said vibrator, a container adapted to receive workpieces to be electroplated, said container being carried at the other end of said elongate member and said body of the vibrator being provided with means for detachably supporting the apparatus which enable it to be alternatively positioned above one of a plurality of electroplating treatment vessels in order to easily attach and transport said apparatus between said vessels for alternative use therewith.

2. Apparatus as claimed in claim 1, in which said container is circular with the center thereof coinciding with the longitudinal axis of said elongate element, the bottom of said container being at least partially made of a helical ramp coaxial with said center, the arrangement being such that the workpieces contained in said container move upwardly along said ramp when said vibrator imparts to the container an oscillatory rotative movement.

3. Apparatus as claimed in claim 1, in which said supporting means comprises a hook enabling the apparatus to be hung above said treatment vessel of an electroplating installation.

4. Apparatus as claimed in claim 3 wherein the mass of said vibrator is sufficiently larger than the combined masses of said elongate member, said container, and said workpieces that the vibrator is subjected to negligible oscillation with respect to oscillation of said container.

* * * * *